US012668338B2

(12) United States Patent
Baek et al.

(10) Patent No.: US 12,668,338 B2
(45) Date of Patent: Jun. 30, 2026

(54) MARINE ORGANISM ANTIFOULING APPARATUS FOR SHIPS USING UV-C MODULE

(71) Applicant: Korea Institute of Ocean Science & Technology [KIOST], Busan (KR)

(72) Inventors: Seung Jae Baek, Busan (KR); Hyoun Kang, Busan (KR); Jung Min Seo, Busan (KR); Sung Min Koo, Busan (KR)

(73) Assignee: Korea Institute of Ocean Science & Technology [KIOST], Busan (KR)

( * ) Notice: Subject to any disclaimer, the term of this patent is extended or adjusted under 35 U.S.C. 154(b) by 439 days.

(21) Appl. No.: 18/207,951

(22) Filed: Jun. 9, 2023

(65) Prior Publication Data

US 2024/0140569 A1 May 2, 2024

(30) Foreign Application Priority Data

Oct. 26, 2022 (KR) ..... 10-2022-0139567

(51) Int. Cl.
*B63B 59/04* (2006.01)

(52) U.S. Cl.
CPC ..... *B63B 59/04* (2013.01)

(58) Field of Classification Search
CPC ..... B63B 59/04; B08B 17/00; B08B 17/02; A61L 2/10
See application file for complete search history.

(56) References Cited

U.S. PATENT DOCUMENTS

| | | | | |
|---|---|---|---|---|
| 5,143,011 | A * | 9/1992 | Rabbette | B63B 59/04 114/222 |
| 10,556,651 | B2 * | 2/2020 | Salters | B08B 17/02 |
| 10,618,613 | B2 * | 4/2020 | Salters | B08B 17/02 |
| 10,689,527 | B2 * | 6/2020 | Phillips | C09D 7/61 |
| 10,793,236 | B2 * | 10/2020 | Salters | A61L 2/10 |
| 11,344,928 | B2 * | 5/2022 | Salters | B63B 59/04 |
| 11,591,764 | B2 * | 2/2023 | Van Delden | C23F 13/16 |

(Continued)

FOREIGN PATENT DOCUMENTS

| | | | | |
|---|---|---|---|---|
| AU | 2020202288 | A1 * | 4/2020 | A61L 2/10 |
| EP | 3718653 | A1 * | 10/2020 | G01N 33/207 |

(Continued)

OTHER PUBLICATIONS

Office Action received in Korean Patent Application No. 10-2022-0139567, dated May 25, 2024, 5 pages.

*Primary Examiner* — Benjamin P Lee
(74) *Attorney, Agent, or Firm* — CM Law LLP; Robert C. Klinger

(57) ABSTRACT

Disclosed is a marine organism antifouling apparatus for ships using a UV-C module. The marine organism antifouling apparatus includes circular or polygonal net units and at least one UV-C module configured to be turned on to emit ultraviolet light by power supplied thereto, the UV-C module being provided at each of the net units, wherein the net units are connected to each other in horizontal and vertical directions to constitute a net member, and ultraviolet light is emitted from the UV-C module to prevent attachment of marine organisms in the state in which an underwater exposure zone of a ship that is moored is surrounded by the net member.

4 Claims, 8 Drawing Sheets

(56) References Cited

U.S. PATENT DOCUMENTS

| | | | | |
|---|---|---|---|---|
| 11,655,009 | B2 * | 5/2023 | Salters | B63B 59/04 114/222 |
| 11,999,449 | B2 * | 6/2024 | Hietbrink | G01N 33/2045 |
| 12,037,091 | B2 * | 7/2024 | Salters | B63B 59/04 |
| 12,059,653 | B2 * | 8/2024 | McMurray | B01D 65/08 |
| 2012/0009236 | A1 * | 1/2012 | Eyster | B63B 59/04 416/247 A |
| 2013/0048877 | A1 * | 2/2013 | Thoren | B08B 17/02 250/492.1 |
| 2017/0190397 | A1 * | 7/2017 | Salters | B01J 19/123 |
| 2017/0197693 | A1 * | 7/2017 | Salters | B63B 59/04 |
| 2020/0109478 | A1 * | 4/2020 | Van Delden | H02J 50/05 |
| 2022/0126958 | A1 * | 4/2022 | Leijssen | A61L 2/10 |
| 2022/0314189 | A1 * | 10/2022 | Liejssen | B01J 19/123 |

FOREIGN PATENT DOCUMENTS

| | | | |
|---|---|---|---|
| JP | 2001182151 | A | 7/2001 |
| JP | 2017526573 | A | 9/2017 |
| KR | 20090035966 | A | 4/2009 |
| KR | 101620459 | B1 | 5/2016 |

* cited by examiner

MARINE ORGANISM ANTIFOULING APPARATUS FOR SHIPS USING UV-C MODULE

RELATED APPLICATION

This patent application claims the benefit and priority of Korean Patent Application No. 10-2022-0139567 filed Oct. 26, 2022, the disclosure of which is incorporated by reference herein in its entirety as part of the present application.

BACKGROUND OF THE INVENTION

Field of the Invention

The present invention relates to a marine organism antifouling apparatus for ships using a UV-C module, and more particularly to a marine organism antifouling apparatus for ships using a UV-C module configured such that UV-C modules configured to radiate ultraviolet light in all directions are provided at a net unit having a specific shape, net units are connected to each other in all directions to constitute a net member, ultraviolet light is radiated in all directions to eradicate marine fouling organisms in the state in which a lower part of a ship is surrounded by the net member, whereby it is possible to efficiently and fundamentally prevent attachment of marine organisms to the surface of the ship.

Description of the Related Art

In general, underwater microorganisms form biofilms in the ocean, acquire nutrients, and grow while maintaining cellular enzyme activity and sharing metabolism with other microorganisms. To this end, the underwater microorganisms are attached to bedrock, concrete, artificial structures, or metal surfaces to live attached lives while forming biofilms. After initial attachment, marine organisms release substances, such as nucleic acid, fatty acid, and protein, including polysaccharides, and many biofilms are formed in a reciprocal process between the substances and microorganisms.

It is known that larvae of marine organisms, such as barnacles, sea squirts, *Serpula, Mytilus edulis*, freshwater clam, tangerine colony, thorny blue, and seaweed, grow in a state of being attached to the biofilms of the microorganisms.

In particular, attachment of marine organisms to the bottom of a ship fundamentally reduces the speed of the ship, whereby fuel efficiency is lowered and the ship is corroded. In addition, the function of various marine structures is deteriorated, and intake pipes and exhaust pipes constituting the structure of a marine facility are clogged, whereby obstacles are caused.

Various means for preventing attachment of marine organisms have been developed.

In an example, antifouling paint for preventing attachment of marine organisms is applied to the bottom of a ship, a marine facility or structure, an intake pipe, or a fish net in order to prevent attachment of marine organisms. Antifouling paint is classified into eluting antifouling paint and non-eluting antifouling paint. The non-eluting antifouling paint prevents attachment of marine organisms using smooth properties of the paint, thereby achieving the antifouling effect. The eluting antifouling paint is manufactured using an organic-based material, an organic metal-based material, and an inorganic-based material having antifouling performance alone or in a mixed state together with various kinds of organic and polymer binders, whereby antifouling performance is maintained due to wear and elution over time.

With recent focus on the environment, harmfulness of an organic antifouling ingredient has come to the fore, and the use of tributyltin (TBT), which has been primarily used as an antifouling ingredient so far, has been totally prohibited due to endocrine disruptor effects thereof. In addition, the use of cuprous oxide, which is an inorganic antifouling additive, has been regulated in developed countries due to strong toxicity and high price thereof, and price competitiveness thereof has been greatly reduced. In recent years, therefore, extract of marine plants obtained from the nature or organic materials having low harmfulness have been developed. In addition, harmful organic derivatives, such as pyrithione, which is mainly used as an antibacterial agent, have been applied a lot. Furthermore, inorganic antifouling materials have been used. However, inorganic materials, such as cuprous oxide, which is generally used as an inorganic antifouling material, have strong toxicity, and therefore regulations thereon must be made in an environmental aspect.

Meanwhile, a robot configured to physically remove marine organisms attached to an underwater part of a ship is disclosed as another means for preventing attachment of marine organisms.

As prior art, Korean Registered Patent No. 10-1620459 (published on May 12, 2016) discloses a wireless control type underwater cleaning robot for ships. The underwater cleaning robot for ships is configured to be controlled in a wireless manner. Since the underwater cleaning robot is configured to be wirelessly controlled, a cleaning zone is not limited and work time is considerably reduced, whereby a considerable cleaning effect is achieved.

However, the antifouling paint disclosed as the means for preventing attachment of marine organisms has problems in that the antifouling effect does not continue, whereby it is necessary to periodically apply the antifouling paint, and the cleaning robot has problems in that it is difficult to completely clean the entirety of the bottom of a ship that is curved and in that lots of time and manpower are required.

SUMMARY OF THE INVENTION

The present invention has been made in view of the above problems, and it is an object of the present invention to provide a means configured to radiate ultraviolet light in all directions in the state in which a lower part of a ship that is moored is surrounded by a net member having UV-C modules, whereby it is possible to eradicate marine fouling organisms or to destroy or damage the molecular structure of DNA and RNA of marine organisms, and therefore it is possible to fundamentally prevent attachment of the marine organisms to the surface of the ship.

In accordance with the present invention, the above and other objects can be accomplished by the provision of a marine organism antifouling apparatus for ships using a UV-C module, the marine organism antifouling apparatus including circular or polygonal net units and at least one UV-C module configured to be turned on to emit ultraviolet light by power supplied thereto, the UV-C module being provided at each of the net units, wherein the net units are connected to each other in horizontal and vertical directions to constitute a net member, and ultraviolet light is emitted from the UV-C module to prevent attachment of marine organisms in the state in which an underwater exposure zone of a ship that is moored is surrounded by the net member.

Each of the net units may be constituted by a rope or a wire made of a fabric, a metal, or a synthetic resin or a pipe having a predetermined thickness.

When each of the net units is constituted by a pipe, the net units may be connected to each other via a joint configured to be rotatable within a predetermined angle range.

The UV-C module may include a case fixed to each of the net units, the case being provided with through-holes formed in all directions, a quartz plate configured to transmit light, the quartz plate being installed in the case so as to close each of the through-holes, a support having installation recesses formed in outer surfaces thereof so as to correspond to the through-holes, the support being inserted into and coupled to the case, and a PCB seated in each installation recess, the PCB having a UV-C LED configured to be turned on to emit ultraviolet light by power supplied thereto.

The support may be provided at each corner thereof with a pressing portion configured to bring the quartz plate into tight contact with the vicinity of a corresponding one of the through-holes.

Opposites of the net member may be fixed to opposite sides of the ship or opposite sides of an anchorage so as to surround the underwater exposure zone of the ship that is moored.

The net member may further includes an anchor wire configured to fix a middle part of the net member to the seabed or the anchorage such that the middle part is not moved by the tide when the opposite sides of the net member are fixed to the opposite sides of the ship or the opposite sides of the anchorage.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

The present invention is installed in the vicinity of an underwater exposure zone of a ship that is moored to emit ultraviolet light having a wavelength of 100 to 280 nm in order that marine organisms, particularly marine fouling organisms, avoid attaching to the ship and in order to destroy the molecular structure of DNA and RNA of fouling organisms such that the fouling organisms are eradicated, whereby it is possible to prevent attachment of the fouling organisms to the underwater exposure zone. The present invention relates to a marine organism antifouling apparatus for ships using a UV-C module, the marine organism antifouling apparatus including circular or polygonal net units and at least one UV-C module configured to be turned on to emit ultraviolet light by power supplied thereto, the UV-C module being provided at each of the net units, wherein the net units are connected to each other in horizontal and vertical directions to constitute a net member, and ultraviolet light is emitted from the UV-C module to prevent attachment of marine organisms in the state in which an underwater exposure zone of a ship that is moored is surrounded by the net member. Consequently, the UV-C module is turned on to emit ultraviolet light in the state in which the underwater exposure zone of the ship that is moored is surrounded by the net member, whereby it is possible to eradicate the marine organisms or to prevent attachment of the marine organisms to the underwater exposure zone as the result of avoidance.

Hereinafter, preferred embodiments of the present invention will be described in detail with reference to the accompanying drawings. In the following description of the present invention, however, a description of known functions and configurations incorporated herein will be omitted when it may obscure the subject matter of the present invention.

Figure 1:
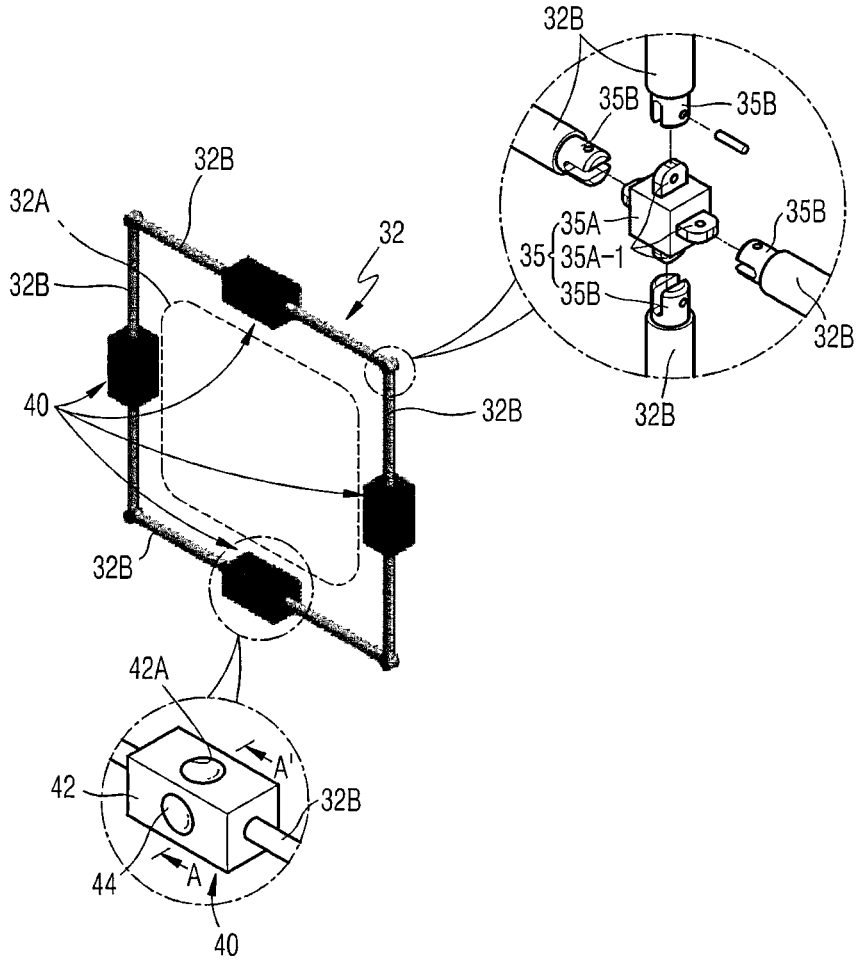
FIG. 1 is a perspective view of a net unit constituting a marine organism antifouling apparatus for ships using a UV-C module according to the present invention.
Figure 2:
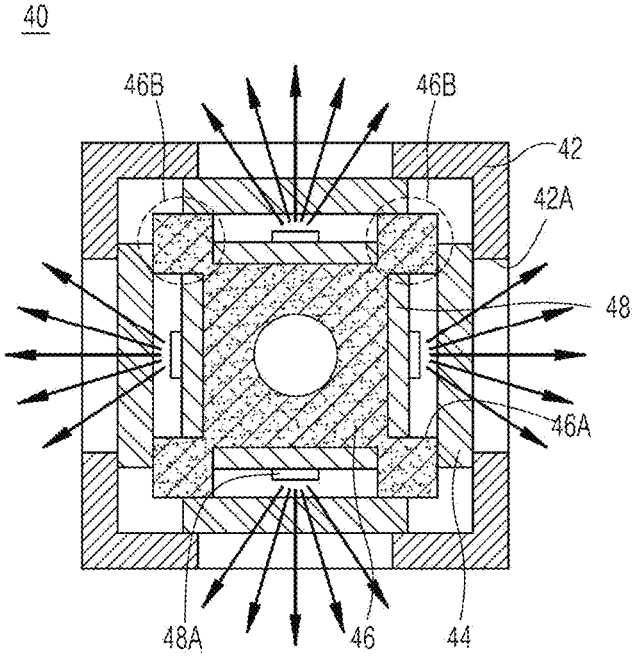
FIG. 2 is a sectional view of the UV-C module taken along line A-A' of FIG. 1.
Figure 3:
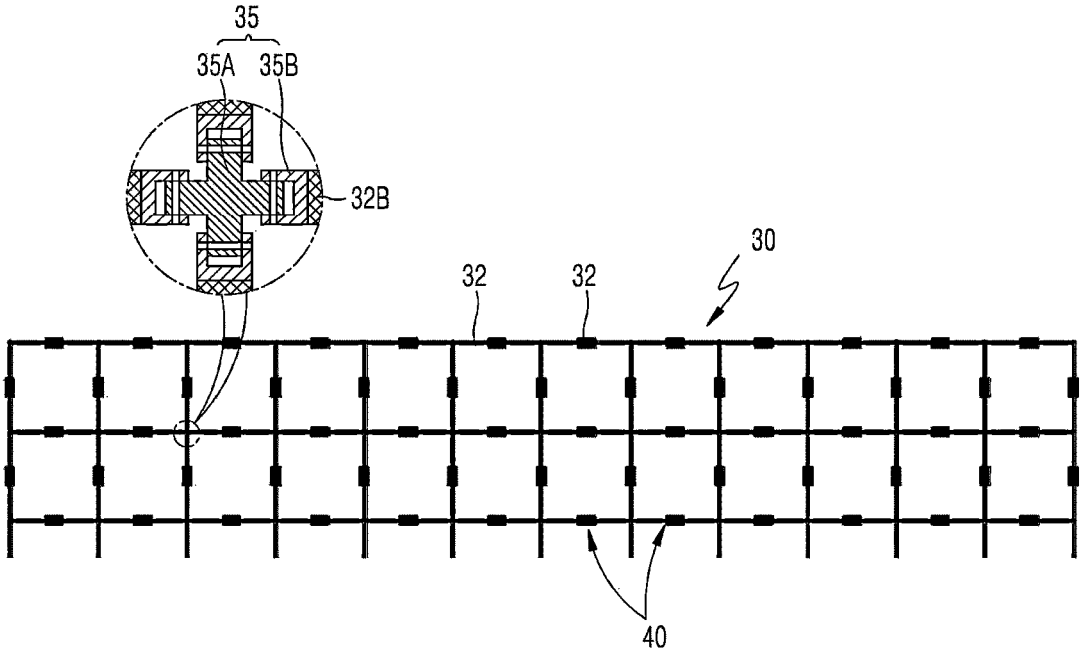
FIGS. 3 and 4 are schematic views showing a marine organism antifouling apparatus for ships using a UV-C module including a net member having the net unit shown in FIGS. 1 and 2.
Figure 4:
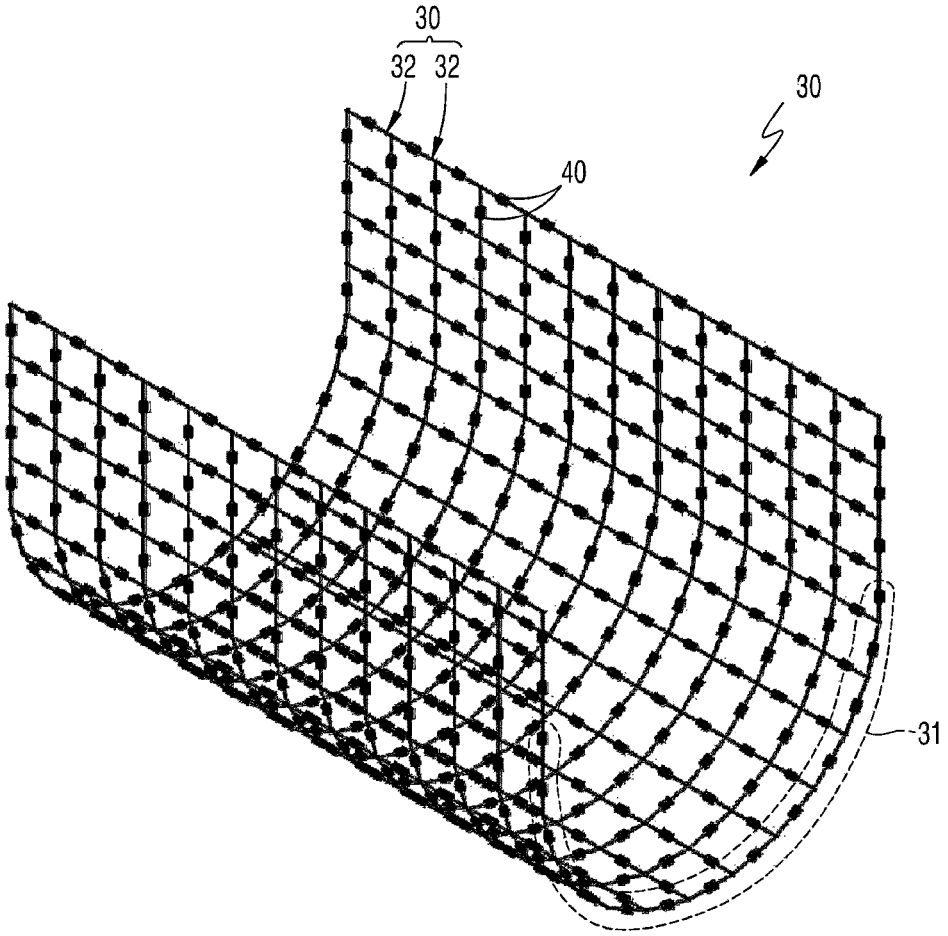

In the accompanying drawings, FIG. 1 is a perspective view of a net unit constituting a marine organism antifouling apparatus for ships using a UV-C module according to the present invention, FIG. 2 is a sectional view of the UV-C module taken along line A-A' of FIG. 1, and FIGS. 3 and 4 are schematic views showing a marine organism antifouling apparatus for ships using a UV-C module including a net member having the net unit shown in FIGS. 1 and 2.

As shown in FIGS. 1 to 4, the marine organism antifouling apparatus for ships using the UV-C module according to the present invention is configured to emit ultraviolet light having a wavelength of 100 to 280 nm to the vicinity of an underwater exposure zone of a ship 10 that is moored such that marine organisms, particularly marine fouling organisms, avoid attaching to the ship, and to destroy the molecular structure of DNA and RNA of the fouling organisms such that the fouling organisms are eradicated, thereby preventing attachment of the fouling organisms to the underwater exposure zone.

The marine organism antifouling apparatus for ships using the UV-C module includes a circular or polygonal net unit 32 and at least one UV-C module 40 configured to be turned on to emit ultraviolet light by power supplied thereto, the UV-C module being provided at the net unit 32. Net units 32 are connected to each other in horizontal and vertical directions to constitute a net member 30 having a predetermined area.

A more detailed description thereof will be given.

As shown in FIGS. 1 and 2, the net unit 32 is configured to have a structure in which a central part 32A is empty such that liquid (water) passes through the central part, and is circular or polygonal. Ends of a plurality of unit members 32B are connected to each other such that the central part 32A of the net unit 32 is defined by the unit members.

Each of the unit members 32B constituting the net unit 32 may be constituted by a rope or a wire made of a fabric, a metal, or a synthetic resin or a pipe having a predetermined thickness. In this embodiment, the unit member 32B is constituted by a pipe; however, the present invention is not limited thereto. The unit member 32B is constituted by a fabric rope or a metal wire.

The unit member 32B may be constituted by a rope or a wire such that the net member 30 is configured in a mesh structure. When the net member 30 is configured in a mesh structure, flexibility of the net member is high, whereby the net member may be easily stored or carried. In addition, when the net member 30 is installed underwater, the net member has a U shape, whereby it is possible to easily surround a lower part (underwater exposure zone 12) of the ship.

When the unit member 32B is constituted by a pipe, as shown in FIG. 1, joints 35 are provided at ends of each of the net units 32 such that the net units 32 can be bent within a predetermined angle when the net units 32 are connected to each other, as shown in FIG. 1.

As shown in FIG. 1, the joint 35 is constituted by a cross (+) type support 35A having support ends 35A-1 protruding in all directions and a connection member 35B having one end pivotably coupled to each support end 35A-1 and the other end coupled to the unit member 32B.

Since the joint 35 is constituted by the support 35A and the connection members 35B, each net unit 32 is rotatable based on the support 35A within a predetermined angle range. When opposite sides of the net member 30 are fixed to an anchorage 50, therefore, a middle part 31 of the net member droops downwards by weight, whereby the net member may surround the lower part of the ship 10 while being formed so as to have a U-shaped curve.

In this embodiment, the joint 35 is constituted by the support 35A and the connection members 35B; however, the present invention is not limited thereto, and any one of various structures, such as a ball joint or a universal joint, may be used.

The net units 32 are connected to each other to constitute a net member 30, as shown in FIGS. 1, 3, and 4. The net member 30 is formed so as to have a mesh structure.

Since the net units 32 are connected to each other in the vertical and horizontal directions to constitute a net member 30, as described above, the net member 30 may be configured in a mesh structure having a predetermined area. When only opposite sides of the net member 30 are fixed, therefore, the middle part 31 of the net member 30 droops downwards by weight. Consequently, the net member has a U-shaped curve, and therefore the net member may stably surround the underwater exposure zone 12 of the ship 10.

Figure 7:
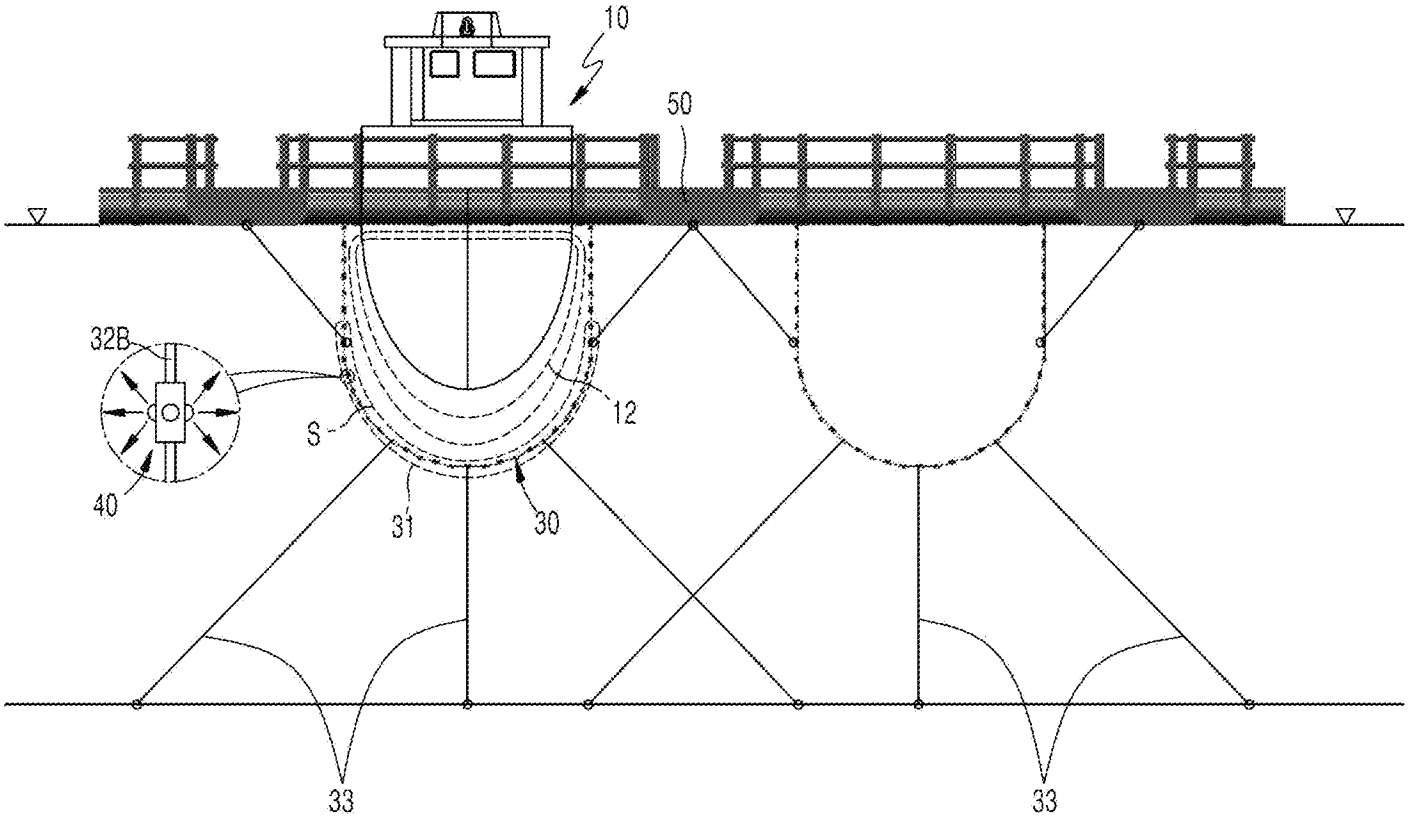

As shown in FIG. 7, the net member 30 further includes anchor wires 33. Each of the anchor wires 33 is configured to fix the middle part 31 to the seabed or the bottom surface of the anchorage 50 such that the middle part 31 is maintained in a U shape without being moved by the tide when opposite sides of the net member 30 are fixed to opposite sides of the ship 10 or opposite sides of the anchorage 50.

When the position of the middle part 31 of the net member 30 installed underwater is fixed by the anchor wires 33, as described above, it is possible to minimize deformation of an ultraviolet irradiation space S of the net member 30 installed underwater and to prevent displacement of the ultraviolet irradiation space even when the tide, ocean currents, or waves occur.

The UV-C module 40 is configured to be turned on to emit ultraviolet light by power supplied thereto and is provided at the net unit 32. Ultraviolet light emitted from an LED device has a wavelength of 100 to 280 nm, preferably 200 to 280 nm. UV-C, which is environmentally friendly light, contains neither chemicals nor mercury, and sterilizes bacteria and viruses by 99.9%. In particular, UV-C destroys the molecular structure of DNA and RNA of bacteria to prevent replication of bacteria.

As shown in FIG. 1, the UV-C modules 40 are coupled to various points of the net unit 32. That is, one or more UV-C modules 40 are coupled to one net unit 32. As shown in FIGS. 1 and 3, the UV-C module 40 may be coupled to each of the unit members 32A constituting the net unit 32. Although not shown in figures, the UV-C module 40 may be provided at the joint 35.

The UV-C module 40 may have any of various structures. In this embodiment, as shown in FIG. 2, the UV-C module 40 is configured to have a structure in which a UV-C LED 48A is provided at each quadrangular surface of the UV-C module such that ultraviolet light is emitted in all directions.

The UV-C module 40 includes a case 42 fixed to the unit member 32B of the net unit 32, the case being provided with through-holes 42A formed in all directions, a quartz plate 44 configured to transmit light, the quartz plate being installed in the case 42 so as to close each through-hole 42A, a support 46 having installation recesses 46A formed in outer surfaces thereof so as to correspond to the through-holes 42A, the support being inserted into and coupled to the case 42, and a PCB 48 seated in each installation recess 46A, the PCB having a UV-C LED 48A configured to be turned on to emit ultraviolet light by power supplied thereto. An airtight packing is installed between each of the quartz plates 44 and an inner edge of a corresponding one of the through-holes 42A of the case 42. An electric wire configured to supply power to each PCB 48 may be disposed in a space formed in the center of the support 46. In addition, when the unit member 32B is coupled through the UV-C module 40, the unit member 32B may extend through the space formed in the center of the support 46.

The case 42 may be circular or polygonal, and a plurality of through-holes 42A may be provided.

A pressing portion 46B configured to bring the quartz plate 44 into tight contact with the vicinity of the through-hole 42A in the case 42 is formed at each corner of the support 46. When the support 46 is inserted into the case 42, the pressing portion 46B brings the quartz plate 44 into tight contact with the vicinity of the through-hole 42A in the case 42. An airtight packing may be installed between the quartz plate 44 and the pressing portion 46B.

Figure 8:
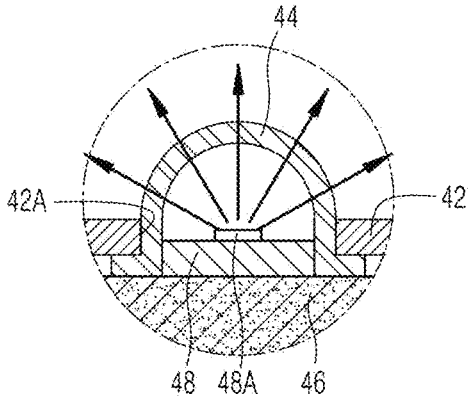
FIG. 8 is a schematic sectional view showing another embodiment of the UV-C module shown in FIG. 2.

As shown in FIG. 8, the quartz plate 44 may be formed in a dome shape. The UV-C LED 48A may be located in the dome-shaped quartz plate 44 so as to emit light.

Since the quartz plate 44 is formed in a dome shape and the UV-C LED 48A is located in the dome so as to emit light, as described above, ultraviolet light may be emitted within an angle range of 180°, whereby a wider zone may be irradiated.

The operation of the marine organism antifouling apparatus configured as described above will be described.

Figure 5:
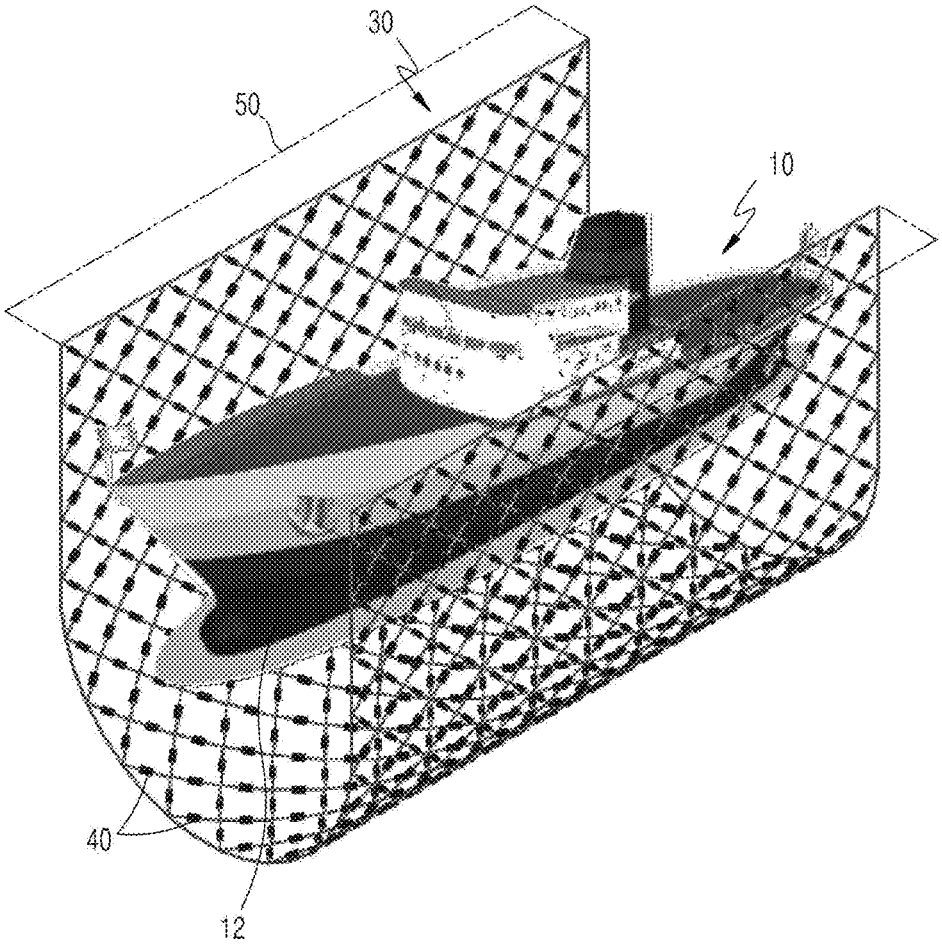
FIG. 5 is a schematic view showing the state in which the marine organism antifouling apparatus for ships using the UV-C module shown in FIGS. 3 and 4 is applied to a ship.
Figure 6:
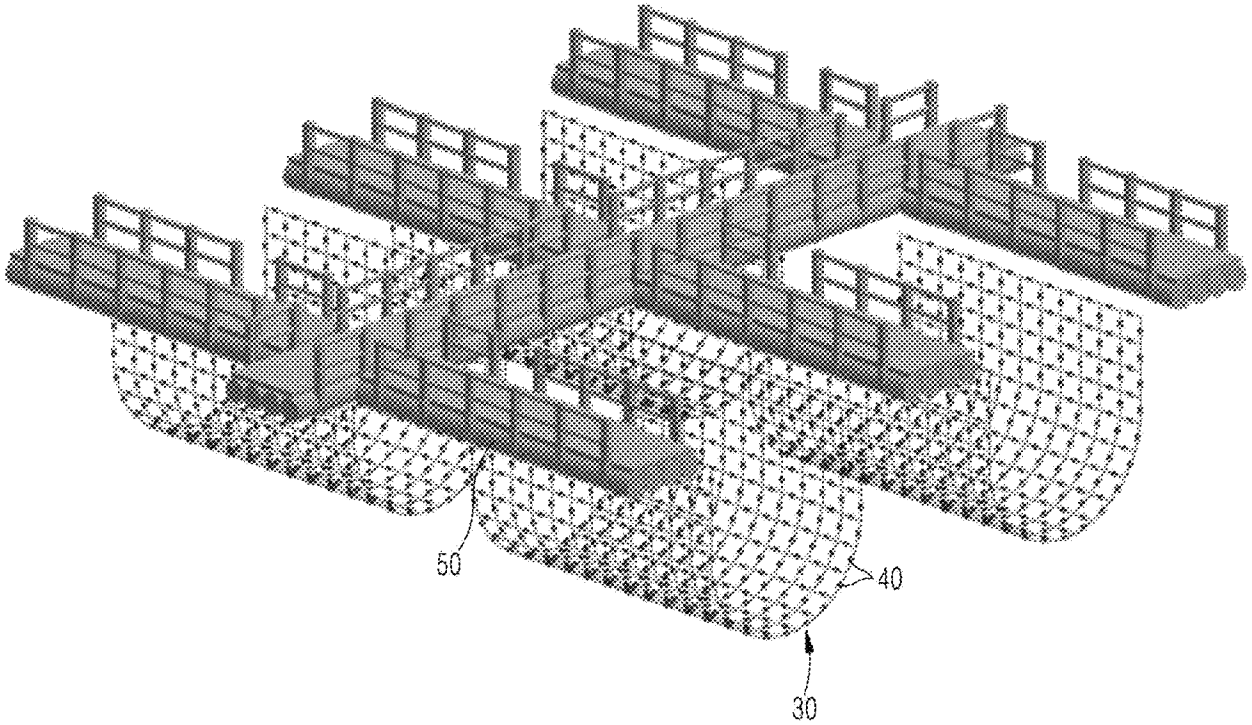
FIGS. 6 and 7 are schematic views showing the state in which the marine organism antifouling apparatus for ships using the UV-C module shown in FIGS. 3 and 4 is applied to a ship mooring facility.

In order to use the marine organism antifouling apparatus according to the present invention, opposite sides of the net member 30 having the UV-C modules 40 are fixed to the anchorage 50, including a quayside, a dock, or a moorage at which the ship 10 is moored, as shown in FIGS. 5 to 7. The opposite sides of the net member 30 may be fixed to the anchorage 50 using any of various connection means, such as shackles or rings. Although not show in the figures, the opposite sides of the net member 30 may be fixed to opposite sides of the ship 10.

When the opposite sides of the net member 30 are fixed to the anchorage 50, as described above, the middle part 31 of the net member 30 droops downwards by weight, whereby the net member is generally formed in a U shape, and therefore the ultraviolet irradiation space S, into which the ship 10 enters, is formed in the net member.

When the net member 30 is formed in a U shape as the result of being installed at the anchorage 50, as described above, the ultraviolet irradiation space S is formed. When the ship 10 enters the anchorage 50, therefore, the ship is located in the ultraviolet irradiation space S without separate work.

At this time, the middle part 31 of the net member 30 installed at the anchorage 50 is supported by the anchor wires 33, whereby deformation or displacement of the middle part 31 due to the tide or waves is prevented.

In the state in which the net member 30 is installed at the anchorage 50 and the ultraviolet irradiation space S is formed, as described above, the ship 10 is moored in the ultraviolet irradiation space S, and power is supplied to each UV-C module 40 such that the UV-C module emits light.

When each UV-C module 40 provided at the net member 30 emits light, UV-C ultraviolet light is emitted in all directions, whereby the UV-C ultraviolet light is radiated to the entirety of the ultraviolet irradiation space S, in which the lower part of the ship 10, i.e. the underwater exposure zone 12, is located.

Since the UV-C ultraviolet light emitted from each UV-C module 40 is radiated to marine organisms, the marine organisms may be eradicated. In particular, the UV-C ultraviolet light may destroy the molecular structure of DNA and RNA of the marine organisms, whereby the marine organisms introduced into the ultraviolet irradiation space S may be eradicated.

As a result, attachment of the marine organisms to the underwater exposure zone 12 of the ship 10 is prevented.

In particular, since ultraviolet light emitted from the UV-C modules 40 is radiated to the entirety of the underwater exposure zone 12 in the state in which the net member 30 surrounds the entirety of the lower part of the ship 10, the ultraviolet light is radiated to the entirety of the ultraviolet irradiation space S, in which the underwater exposure zone 12 is located, whereby the marine organisms introduced into the ultraviolet irradiation space are exposed to the ultraviolet light, and therefore the marine organisms are eradicated.

As described above, a phenomenon in which marine organisms are attached to the underwater exposure zone 12 may be fundamentally prevented by the marine organism antifouling apparatus according to the present invention.

As is apparent from the above description, the present invention has an effect in that net units, each of which has one or more UV-C modules, are connected to each other to constitute a net member having a predetermined area and the UV-C modules are turned on to emit ultraviolet light in the state in which an underwater exposure zone of a ship that is moored is surrounded by the net member, whereby it is possible to eradicate marine organisms or to prevent attachment of the marine organisms to the underwater exposure zone as the result of avoidance.

In addition, the present invention has an effect in that ultraviolet light from the UV-C modules is radiated to the entirety and all the corners of the underwater exposure zone of the ship in the state in which the underwater exposure zone of the ship is surrounded by the net member, whereby it is possible to prevent attachment of the marine organisms to the entirety and all the corners of the underwater exposure zone of the ship.

A marine organism antifouling apparatus for ships using a UV-C module according to the present invention is configured to radiate ultraviolet light (ultraviolet light having a wavelength of 100 to 280 nm) in all directions in the state in which a lower part of a ship that is moored is surrounded by a net member having UV-C modules, whereby it is possible to eradicate marine fouling organisms or to destroy or damage the molecular structure of DNA and RNA of marine organisms, and therefore it is possible to fundamentally prevent attachment of the marine organisms to the surface of the ship. Consequently, the marine organism antifouling apparatus for ships using the UV-C module according to the present invention is used to prevent attachment of marine organisms to a bottom surface of a ship, which is exposed to the seawater, and therefore the present invention has industrial applicability.

What is claimed is:

1. A marine organism antifouling apparatus for ships using a UV-C module, the marine organism antifouling apparatus comprising:

circular or polygonal net units; and at least one UV-C module configured to be turned on to emit ultraviolet light by power supplied thereto, the UV-C module being provided at each of the net units, wherein the net units are connected to each other in horizontal and vertical directions to constitute a net member, wherein each of the net units is constituted by a rope made of a fabric or a synthetic resin, a wire made of a metal, or a pipe having a predetermined thickness, and ultraviolet light is emitted from the UV-C module to prevent attachment of marine organisms in a state in which an underwater exposure zone of a ship that is moored is surrounded by the net member, wherein the UV-C module comprises:

a case fixed to each of the net units, the case being provided with through-holes formed in all directions;

a quartz plate configured to transmit light, the quartz plate being installed in the case so as to close each of the through-holes;

a support having installation recesses formed in outer surfaces thereof so as to correspond to the through-holes, the support being inserted into and coupled to the case, and a PCB seated in each installation recess, the PCB having a UV-C LED configured to be turned on to emit ultraviolet light by power supplied thereto.

2. The marine organism antifouling apparatus according to claim 1, wherein opposites of the net member are fixed to opposite sides of the ship or opposite sides of an anchorage so as to surround the underwater exposure zone of the ship that is moored.

3. The marine organism antifouling apparatus according to claim 1, wherein the net member further comprises an anchor wire configured to fix a middle part of the net member to a seabed or the anchorage such that the middle part is not moved by a tide when the opposite sides of the net member are fixed to the opposite sides of the ship or the opposite sides of the anchorage.

4. The marine organism antifouling apparatus according to claim 1, wherein the support is provided at each corner thereof with a pressing portion configured to bring the quartz plate into tight contact with the vicinity of a corresponding one of the through-holes.

* * * * *